US006414430B2

(12) United States Patent
Watkins et al.

(10) Patent No.: US 6,414,430 B2
(45) Date of Patent: Jul. 2, 2002

(54) DISPLAY HAVING SCRUBBED CATHODOLUMINESCENT LAYER

(75) Inventors: Charles M. Watkins, Eagle; Danny Dynka, Meridian, both of ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/957,741

(22) Filed: Sep. 20, 2001

Related U.S. Application Data

(62) Division of application No. 09/079,138, filed on May 14, 1998, now Pat. No. 6,338,663.

(51) Int. Cl.[7] ..... H01J 29/18

(52) U.S. Cl. ..... 313/497

(58) Field of Search ..... 313/495, 496, 313/497; 445/59

(56) References Cited

U.S. PATENT DOCUMENTS

| | | | | |
|---|---|---|---|---|
| 3,966,287 A | | 6/1976 | Liller | 316/1 |
| 4,130,852 A | | 12/1978 | Peffer et al. | 361/213 |
| 4,351,697 A | | 9/1982 | Shanefield et al. | 156/643 |
| 4,437,844 A | | 3/1984 | Petito et al. | 445/5 |
| 4,801,967 A | | 1/1989 | Snelling | 399/55 |
| 4,908,513 A | | 3/1990 | Masuda et al. | 399/100 |
| 4,929,867 A | * | 5/1990 | Costello et al. | 313/523 |
| 5,800,234 A | * | 9/1998 | Spina et al. | 427/68 |
| 6,057,637 A | | 5/2000 | Zettl et al. | 313/310 |
| 6,099,893 A | * | 8/2000 | Lee et al. | 427/162 |

OTHER PUBLICATIONS

A. Hoffman and P.J.K. Paterson, "Surface and Subsurface 2 keV Electron Stimulated Reduction of Sapphire Studied by Electron Spectroscopy," *Applied Surface Science 93*:301–307, 1996.

A. Pfahnl, "Aging of Electronic Phosphors in Cathode Ray Tubes," *Advances in Electron Tube Technology*, pp. 204–208, Sep. 1960.

D.B.M. Klaasen and D.M. de Leeuw, "Degradation of Phosphors Under Cathode–Ray Excitation," *Journal of Luminescence 37*:21–28, 1987.

Peter A. Keller, *The Cathode–Ray Tube: Technology, History, and Applications*, Palisades Press, New York, New York, 1991, p. 18–22.

J. Sebastian et al., "Electron–Stimulated Surface Reactions Between Residual Vacuum Gas and ZnS Field–Emission–Display Phosphors," *Journal of the Society for Information Display* 3:147–149, 1995.

T. Kishino et al., Multi–Function Large Scale Glass Vacuum Fluorescent Displays for Automotive Applications, *SAE Technical Paper Series*, 830043:51–66, 1983.

Application Note AN–E–1102, "Vacuum Fluorescent Display," Futaba Corporation.

Application Note An–E–1103, "Characteristics of Vacuum Fluorescent Display and Their Method," Futaba Corporation.

* cited by examiner

*Primary Examiner*—Kenneth J. Ramsey
(74) *Attorney, Agent, or Firm*—Dorsey & Whitney LLP

(57) ABSTRACT

Field emission displays having novel cathodoluminescent layers are disclosed. The cathodoluminescent layers are irradiated with electrons having a density of greater than one hundred microamperes/cm$^2$. Significantly, this results in improved emitter life in a field emission display. The display including the scrubbed faceplate has significantly enhanced performance and increased useful life compared to displays including faceplates that have not been scrubbed.

28 Claims, 5 Drawing Sheets

DISPLAY HAVING SCRUBBED CATHODOLUMINESCENT LAYER

CROSS-REFERENCE TO RELATED APPLICATION

This application is a divisional of U.S. patent application Ser. No. 09/079,138, filed May 14, 1998, now U.S. Pat. No. 6,338,663.

GOVERNMENT RIGHTS

This invention was made with government support under Contract No. DABT63-93-C-0025 awarded by Advanced Research Projects Agency (ARPA). The government has certain rights in this invention.

TECHNICAL FIELD

This invention relates in general to field emission displays for electronic devices and, in particular, to improved cathodoluminescent layers for field emission displays.

BACKGROUND OF THE INVENTION

FIG. 1 is a simplified side cross-sectional view of a portion of a display 10 including a faceplate 20 and a baseplate 21 in accordance with the prior art. FIG. 1 is not drawn to scale. The faceplate 20 includes a transparent viewing screen 22, a transparent conductive layer 24 and a cathodoluminescent layer 26. The transparent viewing screen 22 supports the layers 24 and 26, acts as a viewing surface and forms a hermetically sealed package between the viewing screen 22 and the baseplate 21. The viewing screen 22 may be formed from glass. The transparent conductive layer 24 may be formed from indium tin oxide. The cathodoluminescent layer 26 may be segmented into pixels yielding different colors to provide a color display 10. Materials useful as cathodoluminescent materials in the cathodoluminescent layer 26 include $Y_2O_3$:Eu (red, phosphor P-56), $Y_3(Al, Ga)_5O_{12}$:Tb (green, phosphor P-53) and $Y_2(SiO_5)$:Ce (blue, phosphor P-47) available from Osram Sylvania of Towanda Pa. or from Nichia of Japan.

The baseplate 21 includes emitters 30 formed on a surface of a substrate 32, which may be a semiconductor such as silicon. Although the substrate 32 may be a semiconductor material other than silicon, or even an insulative material such as glass, it will hereinafter be assumed that the substrate 32 is silicon. The substrate 32 is coated with a dielectric layer 34 that is formed, in one embodiment, by deposition of silicon dioxide via a conventional TEOS process. The dielectric layer 34 is formed to have a thickness that is approximately equal to or just less than a height of the emitters 30. This thickness may be on the order of 0.4 microns, although greater or lesser thicknesses may be employed. A conductive extraction grid 38 is formed on the dielectric layer 34. The extraction grid 38 may be, for example, a thin layer of polysilicon. An opening 40 is created in the extraction grid 38 having a radius that is also approximately the separation of the extraction grid 38 from the tip of the emitter 30. The radius of the opening 40 may be about 0.4 microns, although larger or smaller openings 40 may also be employed.

In operation, the extraction grid 38 is biased to a voltage on the order of 100 volts, although higher or lower voltages may be used, while the substrate 32 is maintained at a voltage of about zero volts. Signals coupled to the emitter 30 allow electrons to flow to the emitter 30. Intense electrical fields between the emitter 30 and the extraction grid 38 then cause emission of electrons from the emitter 30. A larger positive voltage, ranging up to as much as 5,000 volts or more but generally 2,500 volts or less, is applied to the faceplate 20 via thee. transparent conductive layer 24. The electrons emitted from the emitter 30 are accelerated to the faceplate 20 by this voltage and strike the cathodoluminescent layer 26. This causes light emission in selected areas, i.e., those areas adjacent to the emitters 30, and forms luminous images such as text, pictures and the like.

When the emitted electrons strike the cathodoluminescent layer 26, compounds in the cathodoluminescent layer 26 may be dissociated, causing outgassing of materials from the cathodoluminescent layer 26. When the outgassed materials react with the emitters 30, their work function may increase, reducing the emitted current density and in turn reducing display luminance. This can cause display performance to degrade below acceptable levels and also results in reduced useful life for displays 10.

Residual gas analysis indicates that the dominant materials outgassed from some types of cathodoluminescent layers 26 include hydroxyl radicals. The hydroxyl radicals reacting with the emitters 30 leads to oxidation of the emitters 30, and especially to oxidation of emitters 30 formed from silicon. Silicon emitters 30 are useful because they are readily formed and integrated with other electronic devices on the substrates 32 when the substrate is silicon. Electron emission is reduced when silicon emitters 30 oxidize. This leads to time-dependent and/or degraded performance of displays 10.

In conventional cathode ray tubes ("CRTs"), some scrubbing of the cathodoluminescent screen is typically carried out after the tube is sealed using an electron gun of the type contained in a CRT. "Scrubbing," as used here, means to expose the cathodoluminescent layers (e.g., cathodoluminescent layer 26) to an electron beam until a predetermined charge per unit area has been delivered to the cathodoluminescent layer 26. This scrubbing is carried out at a very low duty cycle and at a very low current density because the electron beam is rastered over the area of the cathodoluminescent screen. It is also carried out at the same current levels that the CRT is expected to support in normal operation, typically 100 microamperes/$cm^2$ or less. However, this approach will not work for scrubbing cathodoluminescent layers 26 for the displays 10, in part because the emitters 30 in the displays 10 are poisoned by the chemical species evolving from the cathodoluminescent layer 26 in response to the scrubbing operation. Moreover, the cathodoluminescent layer 26 is typically much less than a millimeter away from the emitters 30, i.e., the mean free path for any gaseous chemical species evolving from the cathodoluminescent layer 26 is much larger than the distance separating the cathodoluminescent layers 26 from the emitters 30. In contrast, the electron gun used to scrub cathodoluminescent layers in a CRT are not adversely affected by this chemical species and electron guns are, as a rule of thumb, displaced from the cathodoluminescent screen by a distance approximately equal to the diagonal dimension of the CRT screen.

There is therefore a need for a technique to prevent evolution of oxygen-bearing compounds from cathodoluminescent screens in field emission display faceplates.

SUMMARY OF THE INVENTION

In accordance with one aspect of the invention, a low voltage, high current, large area cathode for electron scrubbing of cathodoluminescent layers is described. The electron scrubbing is particularly advantageous for use with cathodoluminescent screens of field emission displays having silicon emitters. The present invention includes an apparatus to irradiate a cathodoluminescent layer in a vacuum with an electron beam and a device to move the cathodoluminescent layer relative to the irradiating apparatus. The irradiation is stopped when a predetermined total Coulombic dose has been delivered to the cathodoluminescent layer. Significantly, the scrubbing results in a cathodoluminescent layer that does not outgas materials that are deleterious to performance of silicon emitters. This results in a more robust display and extended display life.

DETAILED DESCRIPTION OF THE INVENTION

Figure 1:
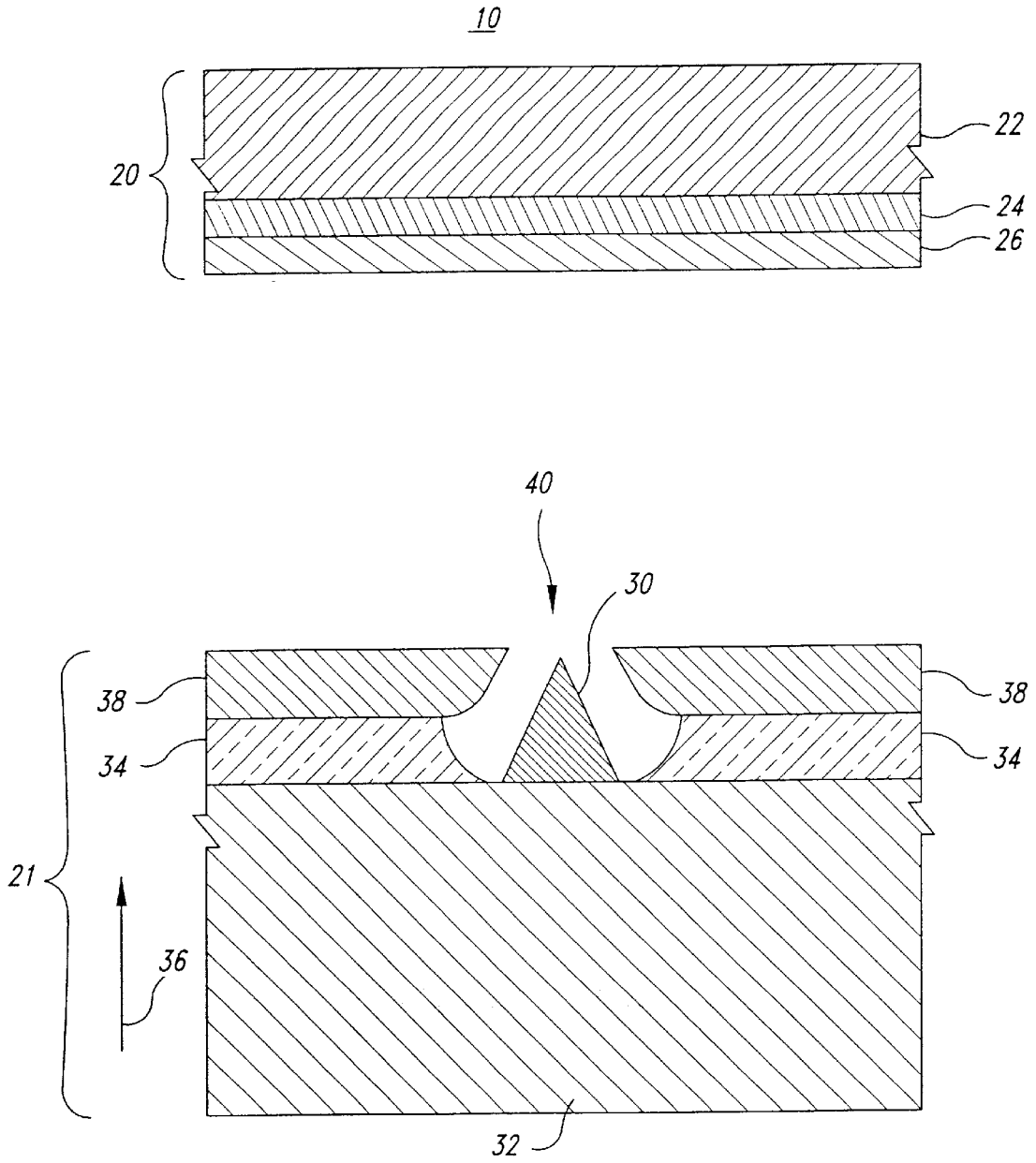
FIG. 1 is a simplified side cross-sectional view of a portion of a display.

Referring again to FIG. 1, when the cathodoluminescent layers 26 for displays 10 are scrubbed with high current density electron beams (i.e., greater than 0.1 milliampere/$cm^2$, typically between one and ten milliamperes/$cm^2$, and about two milliamperes/$cm^2$ in one embodiment) in a high vacuum, the cathodoluminescent layers 26 darken in a reversible manner. When the darkened cathodoluminescent layers 26 are baked in atmosphere at 700° C., the darkening disappears. Repeating the scrubbing process causes the cathodoluminescent layers 26 to darken again. When faceplates 20 having the darkened cathodoluminescent layers 26 are sealed into displays 10 using silicon emitters 30, the emitters 30 do not degrade as is observed when untreated cathodoluminescent layers 26 are used. The darkening of the cathodoluminescent layer 26 suggests that a change in chemical composition of the cathodoluminescent layer 26 has taken place. Because these cathodoluminescent layers 26 do not cause degradation of the emitters 30, the changes in the cathodoluminescent layers 26 due to electron bombardment appear to be beneficial. Because these changes can be reversed by baking the bombarded cathodoluminescent layers 26 in atmosphere, it is likely that the substance or substances causing degradation of the emitters 30 are also present in the atmosphere. Additionally, when faceplates 20 having the transparent conductive layer 24 but not the cathodoluminescent layer 26 are bombarded by electrons in displays 10, there is no degradation of the efficiency of silicon emitters 30 in those displays 10.

These experiments show that the materials causing the efficiency degradation of silicon emitters 30 can be removed by prescrubbing the cathodoluminescent layers 26 with high current, low voltage electron beams prior to sealing the faceplates 20 with the cathodoluminescent layers 26 into the displays 10. This process results in robust displays 10.

Figure 2:
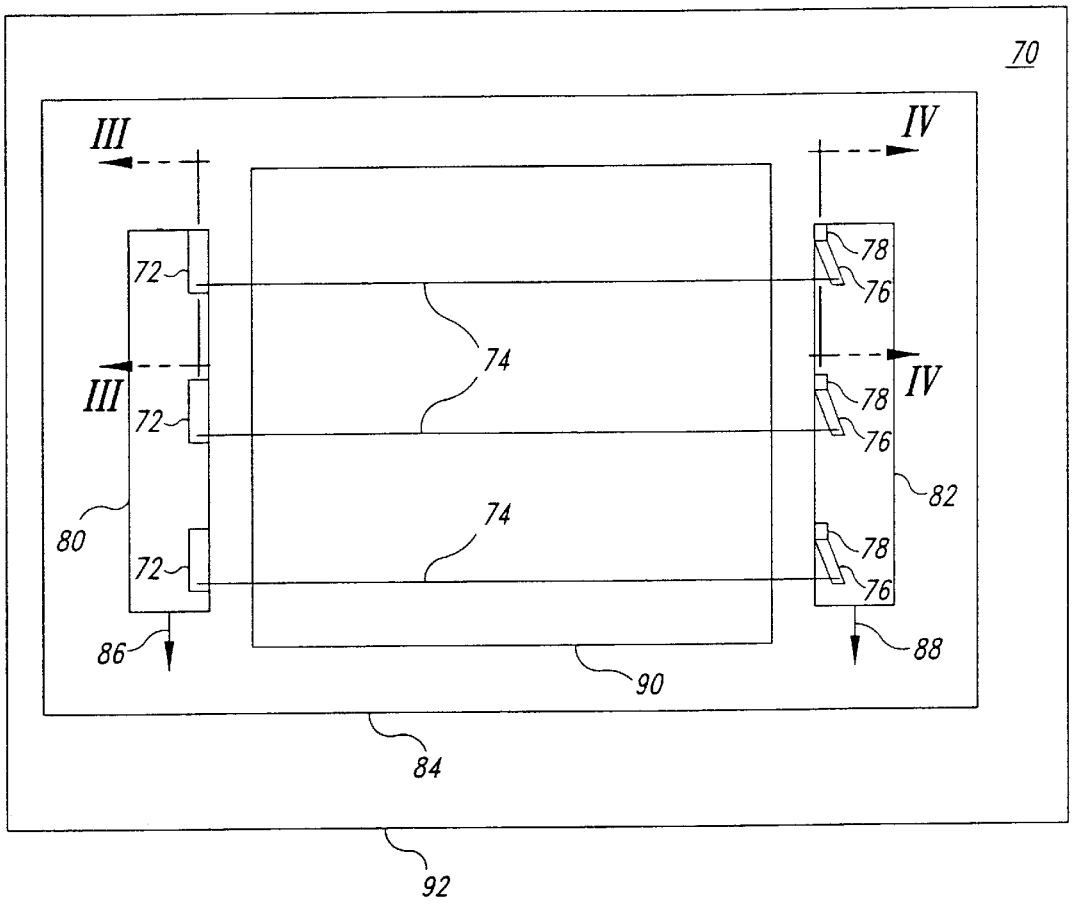
FIG. 2 is a simplified plan view of a portion of a low voltage, high current scrubbing device according to an embodiment of the present invention.

One way of efficiently prescrubbing the cathodoluminescent layers 26 uses a low voltage, high current scrubbing device 70 described below in conjunction with FIGS. 2 through 4. FIG. 2 is a simplified plan view of a portion of the scrubbing device 70 according to an embodiment of the present invention. The scrubbing device 70 includes posts 72, each having one end of a wire cathode 74 coupled to it. The scrubbing device 70 also includes spring loaded contacts 76 coupled to posts 78. Flexure of the bend in the contact 76 provides the spring loading. Each spring loaded contact 76 is coupled to a second end of one of the wire cathodes 74. The couplings between the ends of the wire cathodes 74 and the posts 72 and 78 may be formed through conventional spot welding or any other suitable coupling providing electrical contact and mechanical support. The posts 72 are electrically and mechanically coupled to a first conductive base 80. The posts 78 are electrically and mechanically coupled to a second conductive base 82. The conductive bases 80 and 82 are mounted on to an insulating base 84 and are fastened to the base 84 by conventional means such as a conventional glass or ceramic frit that is fired in an oven.

The wire cathodes 74 typically are tungsten wires having a diameter of 10–20 microns. The wire cathodes 74 are usefully coated with conventional "triple carbonate" to reduce the work function of the wire cathode 74 and thereby increase electron emissions by the wire cathodes 74 when the wire cathodes 74 are heated.

The wire cathodes 74 are heated by a current that is passed between the conductive bases 80 and 82 via interconnections 86 and 88, respectively. Although the wire cathodes 74 are heated to a temperature lower than that required in order to make them red hot, the wire cathodes 74 begin to emit significant numbers of thermionic electrons at this temperature. The heating also causes expansion of the wire cathodes 74. The sagging of the wire cathodes 74 that would otherwise occur is avoided by the tension provided by the spring loading of the contacts 76 coupled to the posts 78.

A voltage is applied between the wire cathodes 74 and the transparent conductive layer 24 on the faceplate 20. This voltage accelerates the thermionically-emitted electrons from the wire cathodes 74 towards the faceplate 20. When these electrons arrive at the faceplate 20, they have a kinetic energy equal to the voltage, but expressed in electron-volts. Optionally, a conductive plate 90 is formed on a surface of the insulating base 84. A negative voltage applied to the conductive plate 90 may increase the efficiency of the scrubbing device 70 by repelling electrons that otherwise would travel from the wire cathodes 74 towards the insulating base 84.

In normal use, the scrubbing device 70 is placed within a vacuum system 92, represented in FIG. 2 by a rectangle surrounding the scrubbing device 70. In one embodiment, the vacuum system 92 is a load-locked system having a conveyor system for transporting the faceplates 20, including the cathodoluminescent layers 26, past the scrubbing device 70. In one embodiment, the faceplates 20 are placed on the conveyor system such that the cathodoluminescent layer 26 faces upward, and the scrubbing devices 70 are mounted just above a plane of cathodoluminescent layers 26 such that the wire cathodes 74 are the part of the scrubbing device 70 that is closest to the cathodoluminescent layer 26.

Cathodes similar to scrubbing device 70, but manufactured for use in vacuum fluorescent displays, and wire cathodes 74, are commercially available from several sources. These cathodes may be ordered built to the buyer's specifications.

Figure 3:
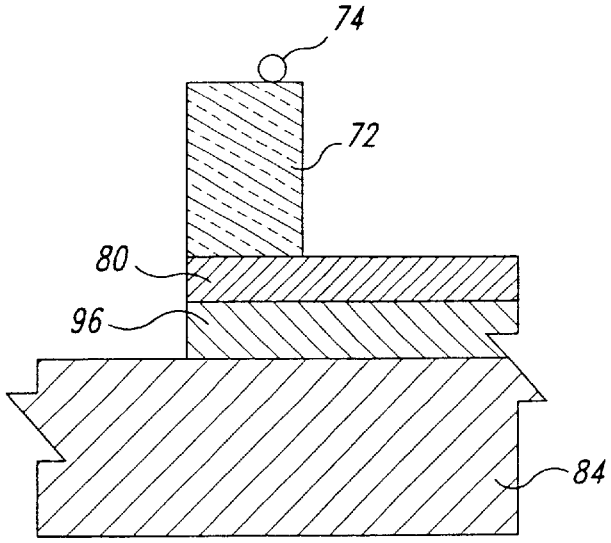
FIG. 3 is a simplified side cross-sectional view, taken along section lines III—III of FIG. 2, of one portion of the cathode of FIG. 2.
Figure 4:
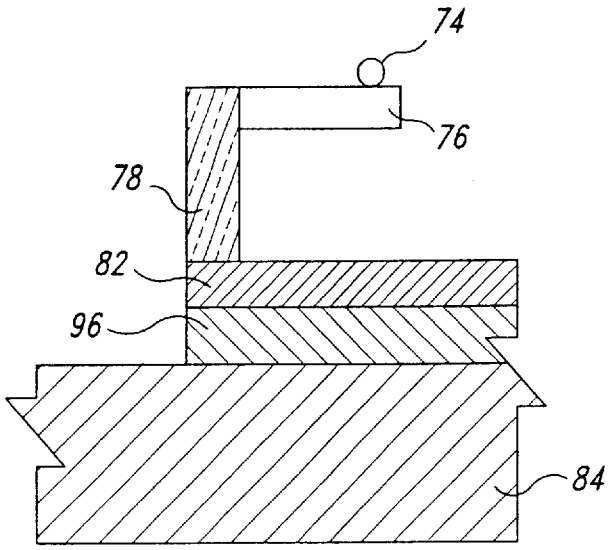
FIG. 4 is a simplified side cross-sectional view, taken along section lines IV—IV of FIG. 2, of another portion of the cathode of FIG. 2.

The bonding layer 96 of FIGS. 3 and 4 is realized, in one embodiment, by screening a frit on to the conductive bases 80 and 82 and/or the insulating base 84. The conductive bases 80 and 82 are placed in the desired position on the insulating base 84. Firing the composite assembly in an oven then provides a robust mechanical bond between the conductive bases 80 and 82 and the insulating base 84.

FIG. 3 is a simplified side cross-sectional view, taken along section lines III—III of FIG. 2, of one portion of the scrubbing device 70 of FIG. 2. This portion includes the post 72 with the wire cathode 74 electrically and mechanically coupled to a top end of the post 72. A bottom end of the post 72 is electrically and mechanically coupled to the conductive base 80. The conductive base 80 is mechanically coupled to the insulating base 84 via a bonding layer 96.

FIG. 4 is a simplified side cross-sectional view, taken along section lines IV–IV of FIG. 2, of another portion of the scrubbing device 70 of FIG. 2. This portion includes the post 78 with the wire cathode 74 electrically and mechanically coupled to the spring-loaded contact 76 formed at a top end of the post 78. A bottom end of the post 78 is electrically and mechanically coupled to the conductive base 82. The conductive base 82 is mechanically coupled to the insulating base 84 via the bonding layer 96.

Figure 5:
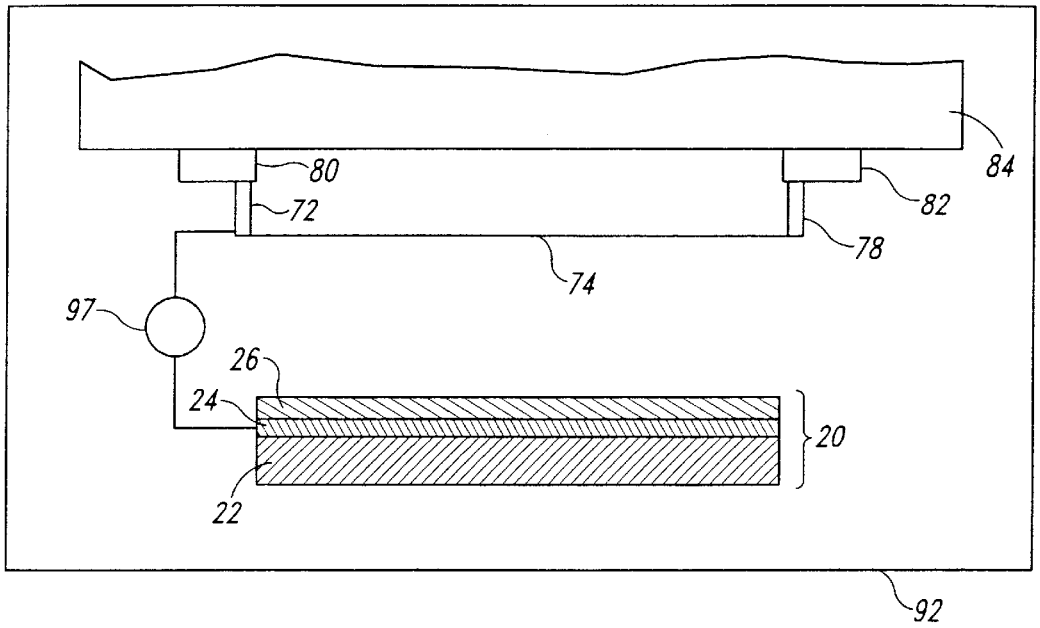
FIG. 5 is a simplified side cross-sectional view of the scrubbing device of FIGS. 2–4 together with the faceplate of FIG. 1 according to an embodiment of the invention.

FIG. 5 is a simplified side cross-sectional view of the scrubbing device of FIGS. 2–4 together with the faceplate of FIG. 1 according to an embodiment of the invention. In the embodiment shown in FIG. 5, the vacuum system 92 encloses both the faceplate 20 and the scrubbing device 70 including the insulating base 84 and the wire cathode 74. A voltage source 97 is electrically coupled between the wire cathode 74 of the scrubbing device 70 and the transparent conductive layer 24 of the faceplate 20. The voltage source 97 supplies the bias that accelerates electrons from the wire cathode 74 to the cathodoluminescent layer 26. In a first embodiment, the wire cathode 74 together with the other elements making up the scrubbing device 70 are moved above the faceplate 20. In another embodiment, the scrubbing device 70 is maintained in a stationary position and the faceplate 20 is moved relative to the wire cathode 74. In yet a third embodiment, both the scrubbing device 70 and the faceplate 20 may be in motion. In all of these embodiments, the objective is to deliver the predetermined electron dose to the cathodoluminescent layer 26, and to do so in a way that is uniform across the area of the cathodoluminescent layer 26.

Figure 6:
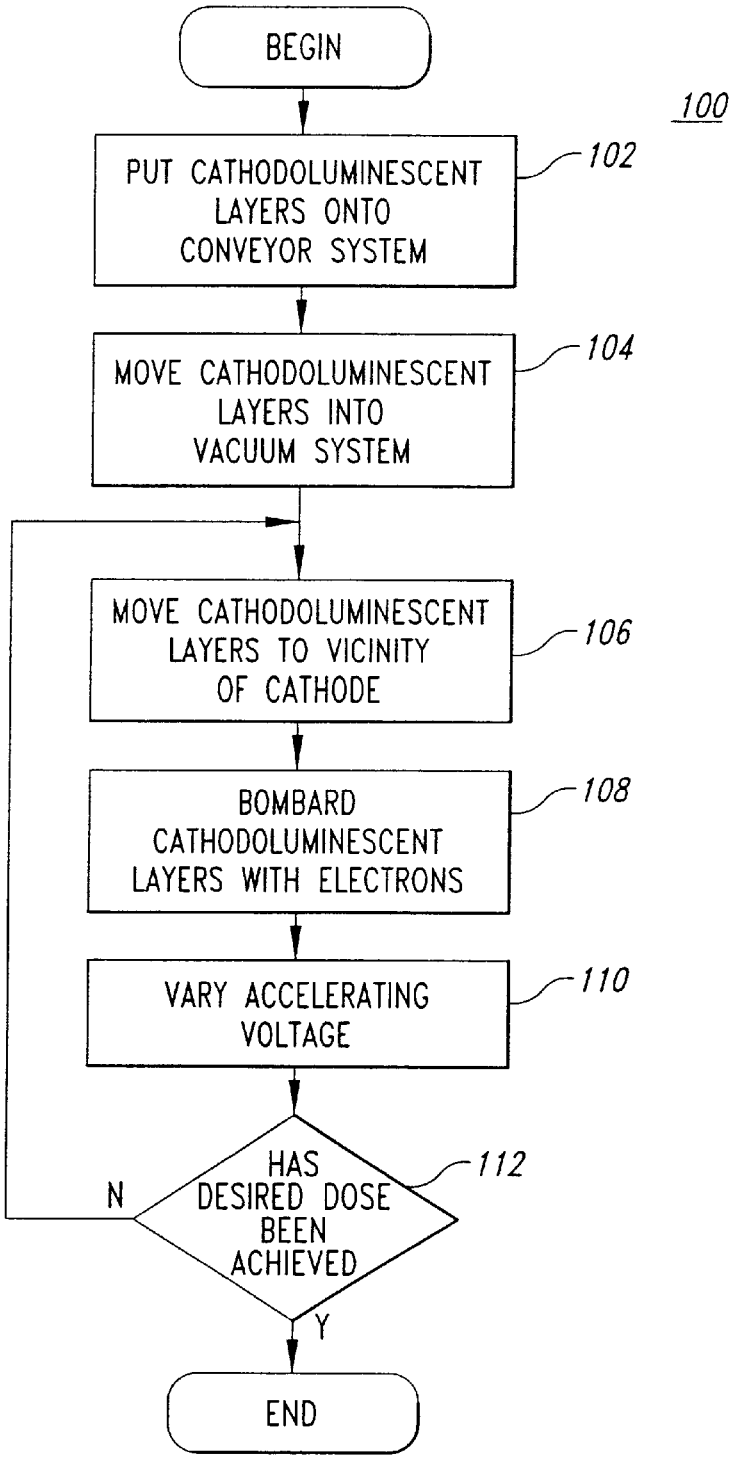
FIG. 6 is a flow chart describing steps in a scrubbing operation using the low voltage, high current cathode according to an embodiment of the present invention.

FIG. 6 is a flow chart describing steps in a scrubbing process 100 using the low voltage, high current scrubbing device 70 of FIGS. 2 through 5. In step 102, the cathodoluminescent-coated faceplates 20 are placed flat, with the cathodoluminescent layer 26 up, on a conveyor system. In step 104, the faceplates 20 are moved through a load lock and into the vacuum system 92 of FIG. 2. This arrangement is used in one embodiment because a peripheral portion of the surface bearing the cathodoluminescent layer 26 on the faceplate 20 includes a layer of glass frit (not illustrated) that will be used to seal the faceplate 20 to the remainder of the display 10. Therefore, it may not be feasible to handle the faceplates 20 by other than their front surface (i.e., the transparent insulating layer 22) at this stage in manufacturing.

In step 104, the faceplates 20 are swept along in the vicinity of (e.g., beneath) the scrubbing device or scrubbing devices 70. Movement of the faceplates 20 relative to the scrubbing devices 70 tends to result in uniform electron doses and uniform scrubbing, despite local variations in electron flux.

In step 106, the faceplates 20 are bombarded with electrons at a current density of one to ten and preferably about two milliamperes/cm$^2$. A return path for this current is provided via an electrical contact (not illustrated) to the transparent conductive layer 24. The accelerating voltage may be chosen to be between 200 and 1,000 volts, although higher or lower voltages may be employed. In contrast to the methods employed in scrubbing of CRT screens, the accelerating voltage for the scrubbing operation for cathodoluminescent layers 26 for displays 10 may be chosen to be higher or lower than the operating accelerating voltage of the completed display 10.

In one embodiment, the scrubbing energy is varied in optional step 110 by dithering the acceleration voltage over a range that is preferably less than thirty percent, e.g., ten or twenty percent. In some applications, it may be desirable in step 110 to ramp the accelerating voltage, i.e., slowly vary the voltage from, e.g., 200 volts to 500 volts, and then reduce the voltage back to 200 volts. This causes the depth to which the particles forming the cathodoluminescent layer 26 are scrubbed to vary and allows removal of impurities from more than just the surface of the particles forming the cathodoluminescent layer 26.

Step 108 (and optionally step 110) is preferably carried out for five to twenty hours until it is determined in a query task 112 that a dose in the range of from five to twenty five Coulombs/cm$^2$ has been delivered to the cathodoluminescent layer 26, although higher or lower doses may be employed. In one embodiment, a dose of seven to twenty Coulombs/cm$^2$ is used. When the query task 112 determines that the desired dose has been achieved, the scrubbing operation 40 ends and the scrubbed faceplate 20 may be incorporated into a display 10 via conventional fabrication procedures, provided that the scrubbed faceplate 20 is not allowed to re-absorb the species that were removed via the process 100. When the query task 112 determines that the desired dose has not yet been achieved, steps 106–112 are repeated.

The scrubbing process 100 may be accompanied by other processes for treating the cathodoluminescent layer 26. The cathodoluminescent layers 26 may be vacuum baked at a temperature of 400 to 700° C. prior to the scrubbing process 100 to remove water and other contaminants. Atmospheric baking may be employed after a first scrubbing process 100 to remove contaminants and a second scrubbing process 100 may be carried out after the atmospheric baking. A hydrogen plasma may be used to clean and chemically reduce the cathodoluminescent layer 26 prior to or following the scrubbing process 100. Chemical reduction reactions may also be employed, such as baking in a carbon monoxide atmosphere.

Cooling may be required for some types of faceplates 20 during the scrubbing process 100 if the energy delivered to the faceplates 20 during scrubbing heats the faceplates 20 to excessive temperatures, e.g., over 500° C. Cooling may be effectuated by use of a duty cycle of less than 100% (i.e., the scrubbing device 70 supplying current less than 100% of the time) or via thermal conduction from the faceplate 20 through the conveyor system or both. For example, a duty cycle of one percent, 10%, 50% or up to 100% could be employed in view of scrubbing current requirements, heating concerns and any other issues.

A number of scrubbing devices 70 may be "tiled" together to provide an arbitrarily large area for electron irradiation of the cathodoluminescent layers 26. This allows cathodoluminescent layers 26 of any size to be scrubbed. For example, a rectangular or square faceplate 20 having a seventeen inch diagonal measurement may be scrubbed using an array of scrubbing devices 70 each individually having a smaller diagonal measurement but collectively providing a larger diagonal measurement. In such an arrangement, the scrubbing devices 70 are typically placed adjacent one another to provide a relatively uniform current density over the total area of the faceplate 20.

The wire cathode 74 may be oriented so that it extends along the direction of travel of the cathodoluminescent layer 26. This orientation may result in uneven treatment of the area of the cathodoluminescent layer 26 because of variations in incident electron flux, leading to areal variations in total Coulombic dose delivered to the cathodoluminescent layers 26. In another embodiment, the wire cathode 74 may be oriented perpendicular to the direction of travel of the cathodoluminescent layers 26. In one embodiment, the wire cathodes 74 are oriented at an oblique angle between 5° and 85°, e.g., 45°, to the direction of travel of the cathodoluminescent layers 26. This may be effected by moving the cathodoluminescent layer 26 at an angle that is oblique to wire cathodes 74 oriented as illustrated in FIG. 2, or by orienting the wire cathodes 74 at an oblique angle on the insulating base 84. It will also be appreciated that the insulating base 84 need not be rectangular but could be any shape.

Figure 7:
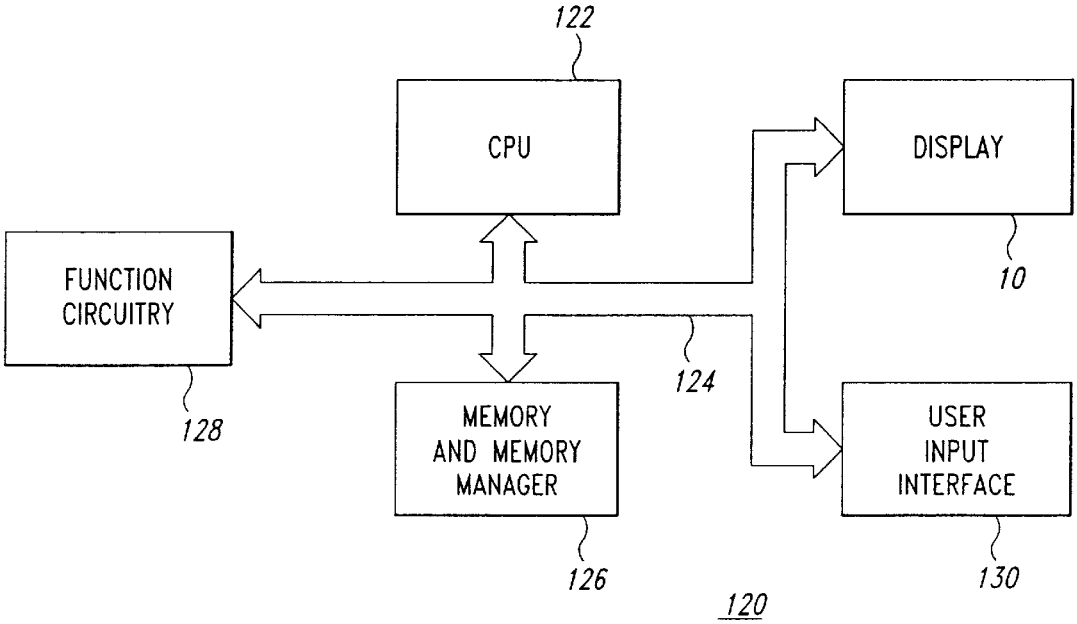
FIG. 7 is a simplified block diagram of a computer using the display having the scrubbed cathodoluminescent layer according to an embodiment of the present invention.

FIG. 7 is a simplified block diagram of a portion of a computer 120 using the display 10 fabricated as described with reference to FIGS. 2 through 6 and associated text. The computer 120 includes a central processing unit 122 coupled via a bus 124 to a memory 126, function circuitry 128, a user input interface 130 and the display 10 including the scrubbed cathodoluminescent layer 26. The memory 126 may or may not include a memory management module (not illustrated). The memory 126 does include ROM for storing instructions providing an operating system and a read-write memory for temporary storage of data. The processor 122 operates on data from the memory 86 in response to input data from the user input interface 130 and displays results on the display 10. The processor 122 also stores data in the read-write portion of the memory 126. Examples of systems where the computer 120 finds application include personal/portable computers, camcorders, televisions, automobile electronic systems, microwave ovens and other home and industrial appliances.

Field emission displays 10 for such applications provide significant advantages over other types of displays, including reduced power consumption, improved range of viewing angles, better performance over a wider range of ambient lighting conditions and temperatures and higher speed with which the display 10 can respond. Field emission displays 10 find application in most devices where, for example, liquid crystal displays find application.

Although the present invention has been described with reference to a specific embodiments, the invention is not limited to these embodiments. Rather, the invention is limited only by the appended claims, which include within their scope all equivalent devices or methods which operate according to the principles of the invention as described.

What is claimed is:

1. A field emission display comprising:

a baseplate comprising:

a substrate; and a group of emitters formed on the substrate; and a faceplate with a cathodoluminescent layer positioned parallel to and near the substrate, the cathodoluminescent layer prepared by a method comprising:

placing the cathodoluminescent layer in a vacuum; and providing electrons at a predetermined location having a density of greater than one hundred microamperes per square centimeter.

2. The display of claim 1 wherein the method further comprises moving the cathodoluminescent layer through the predetermined location.

3. The display of claim 1, further comprising:

a dielectric layer formed on the substrate, the dielectric layer including openings each surrounding one of the emitters; and a conductive extraction grid formed on the dielectric layer, the extraction grid substantially in a plane of tips of the emitters and including an opening surrounding each of the emitters.

4. The display of claim 1 wherein the baseplate further comprises a conductive layer disposed between the substrate and the faceplate and positioned proximate the emitters, the conductive layer having a plurality of openings disposed therethrough, each opening being aligned with a respective one of the emitters.

5. The display of claim 1 wherein providing electrons at a predetermined location comprises applying an accelerating voltage that accelerates electron from an electron source toward the cathodoluminescent layer.

6. The display of claim 1 wherein providing electrons at a predetermined location comprises:

applying an accelerating voltage that accelerates electrons from an electron source toward the cathodoluminescent layer; and dithering the accelerating voltage.

7. The display of claim 1 wherein providing electrons at a predetermined location comprises:

applying an accelerating voltage that accelerates electrons from an electron source toward the cathodoluminescent layer; and dithering the accelerating voltage over a range that is less than thirty percent.

8. The display of claim 1 wherein providing electrons at a predetermined location comprises providing electron at a predetermined location for a time period within the range of about five hours to about twenty hours, inclusive.

9. The display of claim 1 wherein providing electrons at a predetermined location comprises providing electrons emanating from a wire cathode that is heated by an electric current.

10. The display of claim 1 wherein providing electrons at a predetermined location comprises providing electrons emanating from a heated wire cathode coated with a triple carbonate material.

11. The display of claim 1 wherein providing electrons at a predetermined location comprises providing electrons such that the predetermined location is darkened in a reversible manner.

12. The display of claim 1 wherein providing electrons at a predetermined location comprises providing electrons such that the predetermined location is darkened in a reversible manner, and wherein the method further comprises heating the cathodoluminescent layer to reverse the darkening of the predetermined location.

13. The display of claim 1 wherein the method further comprises baking the cathodoluminescent layer in atmosphere at 700° C.

14. The display of claim 1 wherein the method further comprises repeating the providing of electrons at the predetermined location having a density of greater than one hundred microamperes per square centimeter.

15. The display of claim 1 wherein the method further comprises, simultaneously with the providing of electrons at the predetermined location, cooling the predetermined location.

16. A field emission display comprising:

a baseplate including a substrate having at least one emitter formed thereon; and a faceplate having a cathodoluminescent layer positioned proximate the at least one emitter, at least a portion of the cathodoluminescent layer being darkened by directing electrons at a density of greater than one hundred microamperes per square centimeter onto the portion of The cathodoluminescent layer.

17. The display of claim 16 wherein the baseplate further comprises a conductive layer disposed between the substrate and the faceplate and positioned proximate the at least one emitter, the conductive layer having at least one disposed therethrough and aligned with the at least one emitter.

18. The display of claim 16 wherein the electrons that are provided onto the portion of the cathodoluminescent layer are accelerated from an electron source toward the cathodoluminescent layer by an accelerating voltage.

19. The display of claim 16 wherein the electrons that are provided onto the portion of the cathodoluminescent layer are accelerated from an electron source toward the cathodoluminescent layer by a dithered accelerating voltage.

20. The display of claim 16 wherein the electrons that are provided onto the portion of the cathodoluminescent layer are accelerated from an electron source toward the cathodoluminescent layer by an accelerating voltage that is dithered over a range that is less than thirty percent.

21. The display of claim 16 wherein the electrons are provided onto the portion of the cathodoluminescent layer for a time period within the range of about five hours to about twenty hours, inclusive.

22. The display of claim 16 wherein the electrons are provided onto the portion of the cathodoluminescent layer by a wire cathode that is heated by an electric current.

23. The display of claim 16 wherein the electron are provided onto the portion of the cathodoluminescent layer by a heated wire cathode coated with a triple carbonate material.

24. The display of claim 16 wherein the portion of the cathodoluminescent layer is darkened in a reversible manner.

25. The display of claim 16 wherein the portion of the cathodoluminescent layer is darkened in a reversible manner, and wherein the portion of the cathodoluminescent layer is heated to reverse the darkening.

26. The display of claim 16 wherein the portion of the cathodoluminescent layer is baked in atmosphere at 700° C.

27. The display of claim 16 wherein the portion of the cathodoluminescent layer is exposed a second time to electrons at a density of greater than one hundred microamperes per square centimeter.

28. The display of claim 16 wherein the portion of the cathodoluminescent layer is cooled simultaneously with being darkened by electrons.

* * * * *

UNITED STATES PATENT AND TRADEMARK OFFICE

CERTIFICATE OF CORRECTION

PATENT NO. : 6,414,430 B2 
DATED : July 2, 2002
INVENTOR(S) : Charles M. Watkins and Danny Dynka It is certified that error appears in the above-identified patent and that said Letters Patent is hereby corrected as shown below:

Title page,
Item [56], OTHER PUBLICATIONS, reads "Subsurface 2" should read
-- Subsurface 1 --

Column 2,
Line 4, reads "via thee. transparent" should read -- via the transparent --

Column 8,
Line 33, reads "accelerates electron" should read -- accelerates electrons --
Line 49, reads "providing electron" should read -- providing electrons --

Column 10,
Line 13, reads "the electron are" should read -- the electrons are --

Signed and Sealed this

Twenty-eighth Day of January, 2003

JAMES E. ROGAN
*Director of the United States Patent and Trademark Office*